United States Patent [19]

Deschamps et al.

[11] Patent Number: 4,609,456

[45] Date of Patent: Sep. 2, 1986

[54] PROCESS FOR CONVERTING HEAVY PETROLEUM RESIDUES TO HYDROGEN AND GASEOUS DISTILLABLE HYDROCARBONS

[75] Inventors: André Deschamps, Noisy le Roi; Claude Dezael, Maisons Laffitte; Sigismond Franckowiak, Rueil-Malmaison, all of France

[73] Assignee: Institut Francais du Petrole, Rueil-Malmaison, France

[21] Appl. No.: 699,540

[22] Filed: Feb. 8, 1985

[30] Foreign Application Priority Data

Feb. 10, 1984 [FR] France ..... 84 02193

[51] Int. Cl.[4] ..... C10G 47/04; B01J 23/90; C10J 3/46

[52] U.S. Cl. ..... 208/112; 208/147; 502/55; 48/197 R

[58] Field of Search ..... 208/108, 112, 147; 48/197 R; 502/55

[56] References Cited

U.S. PATENT DOCUMENTS

| | | | |
|---|---|---|---|
| 2,378,342 | 6/1945 | Voorhees et al. | 208/147 |
| 3,243,265 | 3/1966 | Annesser | 208/147 |
| 3,816,298 | 6/1974 | Aldridge | 208/112 |
| 3,923,635 | 12/1975 | Schulman et al. | 208/50 |
| 3,948,759 | 4/1976 | King et al. | 208/106 |
| 4,087,348 | 5/1978 | Baird, Jr. et al. | 208/108 |
| 4,127,470 | 11/1978 | Baird, Jr. et al. | 208/58 |
| 4,366,044 | 12/1982 | Swanson | 208/108 |
| 4,366,045 | 12/1982 | Swanson | 208/108 |
| 4,406,772 | 9/1983 | Sasaki et al. | 208/112 |
| 4,473,462 | 9/1984 | Swanson | 208/59 |

FOREIGN PATENT DOCUMENTS

| | | | |
|---|---|---|---|
| 0207688 | 12/1982 | Japan | 208/108 |

*Primary Examiner*—Andrew H. Metz
*Assistant Examiner*—O. Chaudhuri
*Attorney, Agent, or Firm*—Millen & White

[57] ABSTRACT

The invention concerns a process for converting heavy petroleum residues to hydrogen and to gaseous and distillable hydrocarbons, comprising the association of a step of hydropyrolysis (inside tube 3) with a step of catalytic steam-gasification of the formed coke (outside tube 3), characterized in that the hydropyrolysis step is performed in the presence of a solid supporting a carbon gasification catalyst circulating between the hydropyrolysis zone and the coke steam-gasification zone, said steam-gasification being performed in the absence of oxygen.

The petroleum residue, hydrogen and steam are introduced respectively through lines 5, 6 and 7.

The products are withdrawn through line 10. Heat may be supplied by the radiating tube 4.

13 Claims, 2 Drawing Figures

PROCESS FOR CONVERTING HEAVY PETROLEUM RESIDUES TO HYDROGEN AND GASEOUS DISTILLABLE HYDROCARBONS

The invention concerns an integrated process for producing hydrogen and gaseous and distillable hydrocarbons from distillation residues of heavy oils, asphalts obtained by deasphalting said residues or from residual oils of coal liquefaction.

BACKGROUND OF THE INVENTION

The trend of oil products consumptions requires an extended conversion of heavy fractions to light products. Many techniques have already been proposed for this purpose, but their application is made difficult by the high contents of Conradson carbon, asphaltenes and metals of said charges.

Thus, the conventional catalytic refining, cracking and hydrocracking processes are not directly applicable, in view of the quick poisoning of the catalysts. Deasphalting of residues provides effectively an oil of low asphaltenes and organometallic compounds content which is convenient for the above-mentioned catalytic treatments but a sufficient economic return by this production process requires the upgrading of asphalt, particularly by conversion to lighter products. It is precisely the object of the invention to provide an improved process for converting such residues.

The processes using a mere thermal treatment such as thermal cracking or coking are not either convenient since they give a low yield of distillable hydrocarbons which, moreover, are of bad quality, and a high yield of coke or pitch, difficult to upgrade. Different solutions have been proposed to improve the quality of the formed products and to reduce the formation of pitch or coke. A first way consists of a thermal cracking in liquid phase in the presence of a hydrogen donor diluent, at a temperature of 370°-538° C. with a residence time of 0.25-5 hours (U.S. Pat. Nos. 2,953,513 and 4,115,246).

A second way consists of a quick heating of the heavy residue, at a temperature of 600°-900° C., under a hydrogen pressure higher than 5 bars, for a time shorter than 10 seconds, followed with a quenching, so as to avoid recombination of the cracking products (U.S. Pat. Nos. 2,875,150 and 3,855,070). In spite of the improvements obtained by these innovations, substantial amounts of coke or pitch are formed, for which an upgrading method remains difficult to find.

It has already been proposed to gasify these final residues, coke or pitch, by reaction with steam and oxygen to produce the hydrogen required for the preceding treatments. The applicant, in particular, has described in U.S. Pat. No. 4,405,442, a process for converting heavy oils to light products integrating said different steps. Although it offers many advantages with respect to the prior art processes (complete conversion of the heavy oil with a high yield of liquid hydrocarbons), this process has the disadvantage of using oxygen in the coke oxy-steam-gasification step, which is conducted at high temperature (900°-1500° C.). This oxygen addition supplies heat to the gasification zone, by partial combustion of the coke, and for the endothermicity of the steam-gasification reaction. However, addition of oxygen results in technological complexities and hence requires heavy investments, particularly for the oxygen producing unit.

On the other hand, it is known that alkali, alkaline-earth and transition metals, mainly as carbonates, hydroxides and oxides, catalyze the gasification of carbon and/or carbonaceous materials by steam and/or carbon dioxide (see for example the paper of Taylor and Neville J.A. C.S. 1921, 43, pages 2055 and following).

By using these catalysts it is possible to substantially reduce the temperature at which gasification takes place, for example to 600°-800° C. instead of 900°-1500° C. in non catalytic processes.

The thermodynamic balance at such lower temperatures also contributes to make the gasification process less endothermic, so that the heat required for gasification may be supplied by other means than oxygen injection.

One of these means consists, for example, of circulating a solid heat carrier between the coke gasification zone and the hydropyrolysis zone, for transferring a part of the heat generated by the hydropyrolysis exothermic reactions, to the gasification zone.

OBJECTS OF THE INVENTION

A first object of the present invention is to provide an improved process, more economical than the already known processes, for converting heavy residues to light products.

A second object of the invention is to increase the conversion yields of heavy residues to gaseous and distillable hydrocarbons.

SUMMARY OF THE INVENTION

The integrated process for converting heavy petroleum residues to hydrogen and to gaseous and distillable hydrocarbons, whereby the above-stated results can be achieved, comprises:

(a) a first step wherein the petroleum residue and hydrogen are simultaneously contacted with a catalyst selected from the group of oxides and carbonates of alkali and alkaline-earth metals, obtained from step (b) at a temperature of 530°-800° C., under a pressure of 15-100 bars, to produce hydrocarbons gases and vapors and coke which deposits on the catalyst, the coked catalyst being separated from said hydrocarbons, (b) a second step wherein the coked catalyst, separated from hydrocarbons in step (a), is contacted with steam, substantially in the absence of molecular oxygen, at a temperature of 600°-800° C., under a pressure of 15-100 bars, preferably close to that of step (a), for a sufficient time to gasify at least 90% of the deposited coke to hydrogen, carbon monoxide, carbon dioxide and methane, and wherein said catalyst is recycled to step (a).

DETAILED DESCRIPTION OF THE INVENTION

The process according to the invention will be described hereinafter more in detail.

The heavy hydrocarbons charges which may be advantageously treated by this process are all petroleum residues having a Conradson carbon content higher than 10% by weight and a high content of nickel and vanadium metals, e.g. higher than 50 parts per million by weight. Examples are straight-run and vacuum distillation residues of petroleum, some very heavy crude oils, asphalts obtained by deasphalting these oils or residues with solvent, pitches, bitumen and heavy oils from coal liquefaction.

The active substance of the catalysts used in the process of the invention may be selected from products known for their catalytic action in gasification of carbon or of solid carbonaceous materials such as coals and cokes, by steam or carbon dioxide. They are mainly oxides, hydroxides and carbonates of alkali or alkaline-earth metals such as potassium, sodium, lithium, cesium, calcium, barium, alone or in combination with compounds of transition metals such as iron, cobalt, nickel and vanadium, used separately or as mixtures.

The one or more active forms of said elements which intervene, in fact, in the reaction medium and are not exactly known. Generally, they can be introduced as substances decomposable to oxide or reduced metal in the operating conditions of the process, for example as formates, acetates, naphthenates, nitrates, sulfides and sulfates. Preferably, potassium, sodium or calcium oxide or carbonate will be used in association with one or more compounds of transition metals such as iron, vanadium and nickel, in a proportion of 0.01–0.5 atom of transition metal per atom of alkali or alkaline-earth metal. As a matter of fact, it has been observed, during the operation of the process with a catalyst containing initially only potassium, sodium or calcium, that the introduction in the catalyst mass of transition metals originating, for example from the treated heavy hydrocarbons charge, resulted, within certain limits, in an improvement of the hydrocarbons yield.

To facilitate the use of circulating fluid beds, these catalysts are preferably deposited on carriers of a particle size ranging from 50 to 800 micrometers, such as alumina, titanium oxide, limestone, dolomite, natural clay as kaolin, montmorillonite, attapulgite or petroleum coke. The specific surface of the carrier is preferably from 1 to 30 $m^2/g$.

The catalyst mass may be prepared by impregnating the carrier with a solution of the one or more catalysts or precursors thereof or sometimes with a dry mixture of the carrier and the catalyst (or its precursor). It is also possible to start with the carrier alone and to progressively introduce the one or more catalysts as aqueous solution or still as a solution, suspension or aqueous emulsion in the heavy oil charge.

The active metals content of the catalyst mass may vary to a large extent according to the nature of the catalyst, the nature and the porosity of the carrier. It generally ranges from 1 to 50% by weight, preferably 5–30% by weight.

DESCRIPTION OF A PREFERRED EMBODIMENT

A preferred embodiment is described hereinafter:

In a first step, called hydropyrolysis step, the petroleum residue, admixed with hydrogen and preheated at a temperature of 200°–400° C., is contacted with the catalyst mass obtained at a temperature of 600°–800° C., from the coke steam-gasification step, described below. The preheating of the charge, the temperature and the mass flow rate of the catalyst mass are so adjusted as to obtain an average temperature ranging from 530° to 800° C. in the hydropyrolysis zone.

Generally the preferred temperature is close to the lower value of said range when it is desired to favour the production of liquid hydrocarbons and close to the upper limit of said range when it is desired to favour the production of gaseous hydrocarbons.

As a general rule, the coke formation is lower as hydrogen partial pressure is higher. The hydrogen flow rate is usually 200–3000 $Nm^3$ per ton of treated petroleum residue and preferably 400–2000 $Nm^3$ per ton. The operating pressure is at least 15 bars and generally lower than 100 bars so as to limit the cost of the unit. Preferably, it ranges from 20 to 80 bars.

The residence time of the gaseous products in the hydropyrolysis zone is 0.1–60 seconds, preferably 0.5–30 seconds.

The coke formed during the hydropyrolysis step deposits on the particles of the catalyst mass, which facilitates the separation of the hydrocarbon gases and vapors produced by cracking of the charge. The flow rate of the catalyst mass is so adjusted that the amount of deposited coke does not exceed 20% by weight of the catalyst mass and is preferably lower than 15%. It generally ranges from 1 to 15 tons, preferably from 3 to 12 tons per ton of treated heavy residue. A sufficiently high flow rate of catalyst mass provides for a good dispersion of the residue on the catalyst surface, thereby decreasing the coke formation and improving the contact of the latter with the catalyst, thus facilitating a subsequent gasification. It also provides, by heat-reserve effect, a better control of the reaction temperature by heating the charge very quickly to the reaction temperature and then by limiting the heating of the cracking products due to the exothermicity of the hydropyrolysis reactions.

As a result, the coke formation is reduced and the quality of the cracking products improved.

In the second step, called steam-gasification step, the catalyst mass, charged with coke originating from the hydropyrolysis zone, is contacted with steam at a temperature of 600°–800° C. to convert the major part of coke to hydrogen, carbon monoxide, carbon dioxide and methane.

The amount of steam is generally 1.5–8 tons and preferably 2–5 tons per ton of coke. The operating pressure may vary to a large extent, for example from 1 to 100 bars. However, in order to facilitate the circulation of the catalyst mass, it is convenient to use a pressure close to that of the hydropyrolysis step.

The residence time of the catalyst mass in the gasification zone, required for gasifying the deposited coke, is highly variable in relation with the operating conditions and the efficiency of the catalyst. Generally it is from 0.5 to 10 hours.

This latter step is preferably conducted in the absence of molecular oxygen so as to facilitate the integration of the hydropyrolysis and steam-gasification steps. This means that the oxygen content of the steam introduced in the steam-gasification zone is generally lower than 1% by volume, preferably lower than 0.1% by volume.

The total steam-gasification process being endothermic, it is generally necessary to supply heat to the gasification zone. This heat may be added by overheating the introduced steam or by means of heat-exchanging tubes immersed in the fluid bed, a hot fluid circulating through said tubes. These tubes are, for example, radiating tubes wherein a portion of the combustible gases produced in the process is burnt.

The hydropyrolysis and steam-gasification steps may be conducted in separate reactors equipped with known systems for circulating the catalyst mass therebetween. However, a preferred embodiment of the invention, which results in a substantial investment saving, consists of integrating these two steps in a single reactor comprising two reaction zones, the catalyst mass circulating therebetween. This advantageous arrangement is made possible in view of the fact that oxygen is not used in the gasification zone and the reactants and products present in both zones are thus compatible.

BRIEF DESCRIPTION OF THE DRAWINGS

This preferred embodiment is illustrated by the accompanying drawings, wherein.

DETAILED DESCRIPTION OF THE PREFERRED EMBODIMENT

Figure 1:
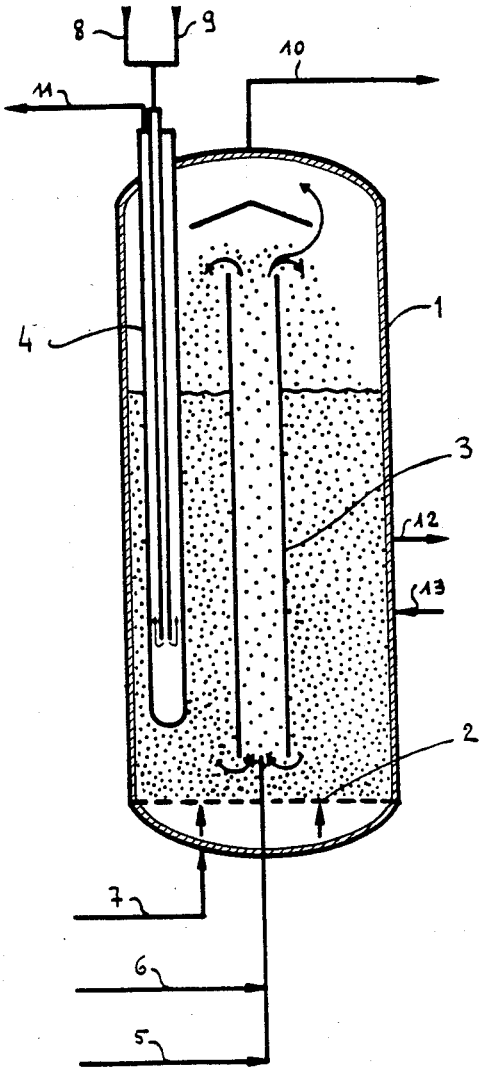
FIG. 1 is a cross-sectional diagrammatic view of a reactor wherein the two steps of hydropyrolysis and steam-gasification are integrated.

The integrated reactor, as shown in FIG. 1, comprises a pressure-proof enclosure (1) wherein a grid (2) supports a fluid bed of catalyst. A tube (3) dipping into the fluid bed separates the internal hydropyrolysis zone from the annular steam-gasification zone. The charge of heavy residue introduced through line (5) and hydrogen through line (6), after preliminary pre-heating, are injected, as mixture, at the bottom of the dip tube (3) and pass therethrough upwardly, driving therewith a flow of catalyst particles. Preheated steam, supplied through line (7), is injected below the grid supporting the fluid bed and preferentially passes through the annular zone. The catalyst mass thus flows upwardly through the hydropyrolysis zone, where its coke content is increased, and downwardly through the steam-gasification zone, at a rate depending on the linear velocities of the gas flows in each of said zones. By way of example, the linear velocity of the gas flow is 1–50 cm/s in the steam-gasification zone and 50–300 cm/s in the hydropyrolysis zone.

The reaction products obtained from the two zones are admixed at the top of the reactor and withdrawn, as mixture, through line (10).

Additional heat is supplied to the steam-gasification zone through one or more radiating tubes (4) immersed in the fluidized bed of catalyst. Accordingly, air is injected through line (8) and a combustible gas through line (9). The combustion gases are discharged through line (11). Catalyst may be withdrawn or added to the catalyst mass, respectively through lines (12) and (13).

Figure 2:
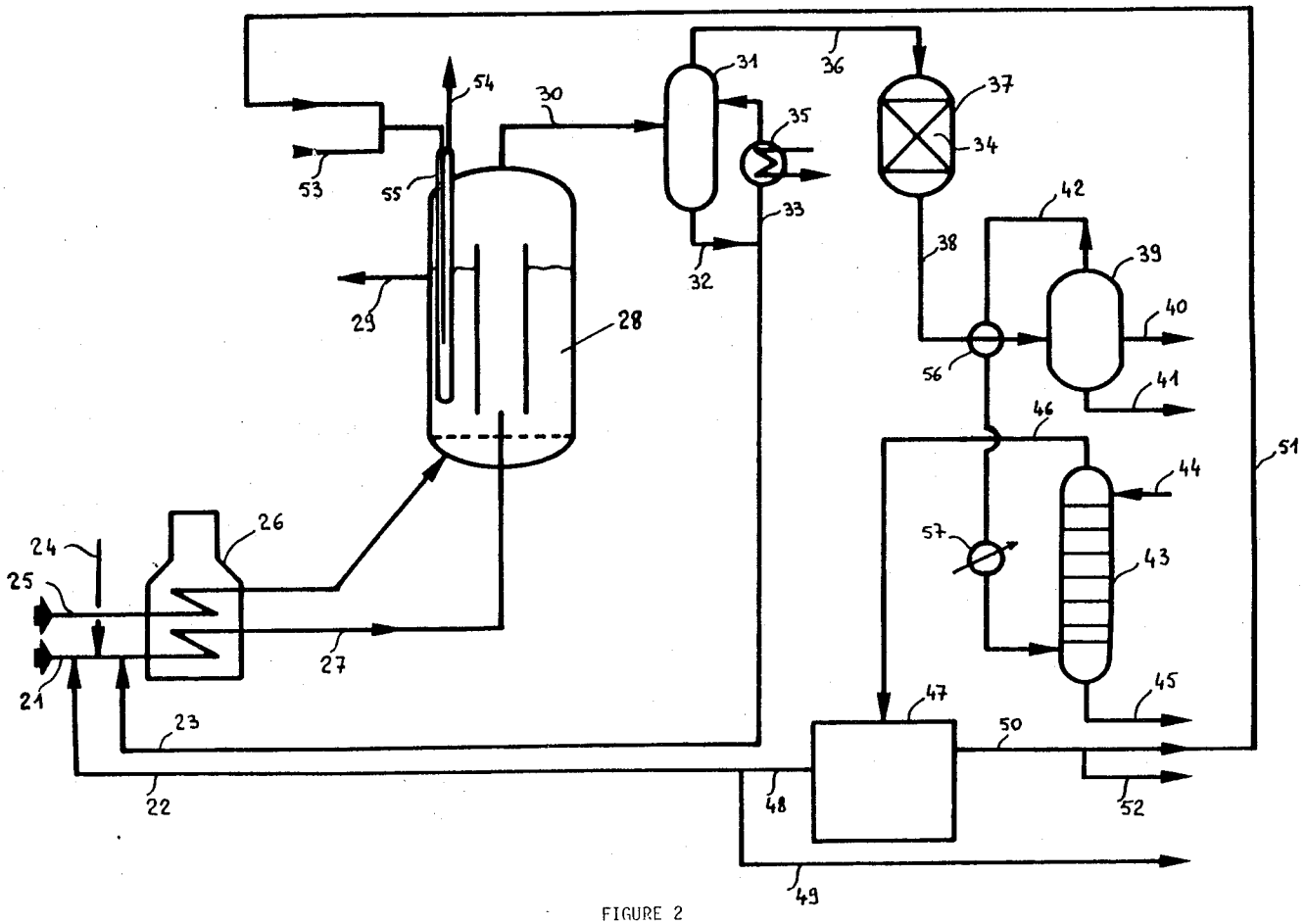
FIG. 2 is a flow-sheet of a process for producing distillates, combustible gases and hydrogen from a heavy petroleum residue, illustrating an example of integration of the reactor of FIG. 1.

The diagram of FIG. 2 shows an example of integration of said reactor in a process for producing distillates, combustible gases and hydrogen from a heavy petroleum residue.

The charge of heavy residue, introduced through line (21), is admixed with hydrogen supplied through line (22), a heavy recycle oil fed through line (23) and, optionally, an additional catalyst amount supplied through line (24). The mixture, preheated in furnace (26), is introduced through line (27) at the bottom of the hydropyrolysis zone of the previously described reactor (28) (reactor 1 of FIG. 1). Steam, supplied through line (25) and preheated in furnace (26), is injected below the grid of reactor (28). Used catalyst may be withdrawn through line (29) to avoid a too substantial accumulation of such metals as nickel and vanadium, originating from the heavy residue charge. The vapor effluents from hydropyrolysis and gasification zones are withdrawn, as mixture, through line (30), then separated, after cooling in drum (31), to a heavy oil liquid phase withdrawn through line (32) and a vapor phase, discharged through line (36). This operation is conducted by contacting the flow (30) with a stream of recycle heavy oil, circulating through line (33) and through heat exchanger (35), at a temperature of 300°–420° C., under a pressure close to that prevailing in the reactor. The collected heavy oil, containing fine catalyst and coke particles, is recycled through line (23), as diluent for the heavy residue charge.

The vapor effluent circulating through line (36), containing condensable hydrocarbons, gaseous hydrocarbons, methane, ethane, propane, butane, hydrogen, carbon monoxide, carbon dioxide, steam, hydrogen sulfide and ammonia, is treated in reactor (37), over a hydrodesulfurization catalyst (34) formed of Co, Mo, Ni and/or W compounds, deposited on an alumina or silica-alumina carrier. The temperature and pressure are generally close to those prevailing in separator (31). During said step, the hydrocarbons vapors are hydrogenated and hydrodesulfurized to a certain extent so as to improve their quality and, simultaneously, carbon monoxide is largely converted to hydrogen, methane and carbon dioxide by reaction with steam.

The products withdrawn through line (38) are then cooled down in exchanger (56) and separated, on drum (39), into an aqueous phase containing hydrogen sulfide, ammonia and carbon dioxide, withdrawn through line (41), a liquid hydrocarbons phase discharged through line (40), and a gaseous phase mainly containing hydrogen, methane, ethane, propane, butane, carbon dioxide, carbon monoxide and hydrogen sulfide, withdrawn through line (42).

After cooling in exchangers (56) and (57), this gaseous stream is washed, in a known manner, in column (43), by means of a solution of hydrogen sulfide and carbon dioxide absorbing agent, introduced through line (44) and discharged through line (45).

The purified effluent is fed, through line (46), to fractionation zone (47) wherefrom are separated, by known techniques as cryogeny or adsorption on molecular sieves, a flow of high hydrogen content, discharged through line (48), and a combustible gas, withdrawn through line (50), mainly containing gaseous hydrocarbons, hydrogen and a small proportion of carbon monoxide. The hydrogen flow (48) is separated in two fractions: One fraction is recycled through line (22) to the hydropyrolysis zone, the other is withdrawn through line (49). The combustible gas stream (50) is also separated in two fractions: one is fed, through line (51), to the fluid bed heating system (55), where it is burnt with additional air supplied from line (53), by giving fumes discharged through line (54); the other is withdrawn through line (52).

EXAMPLES

The following non limitative examples illustrate the invention.

They all concern the treatment, by the process of the invention, of a heavy residue charge consisting of an asphalt obtained by deasphalting with pentane a petroleum distillation residue having the following characteristics:

| Elementary analysis | |
|---|---|
| C % by weight | 84.89 |
| H % by weight | 8.2 |
| O % by weight | 0.95 |
| N % by weight | 0.66 |

-continued

| Elementary analysis | |
|---|---|
| S % by weight | 5.25 |
| Ni ppm by weight | 80 |
| V ppm by weight | 350 |
| asphaltenes % by weight | 22.6 |
| Conradson carbon % by weight | 41.1 |
| $\frac{H}{C}$ atomic ratio | 1.16 |

The apparatus comprises essentially an integrated reactor of the type shown in the diagram of FIG. 1, to which reference is made. It consists of a steel tube (1), of 7 meters height and 30 cm internal diameter, equipped at its lower part with a grid (2) supporting a fluid bed of catalyst mass of about 4 meters height. The internal tube (3), dipping into the fluid bed, is of 5 meters height and 6 cm internal diameter. Electric furnaces may be used for preheating the charge of asphalt, hydrogen and steam, respectively introduced through lines (5), (6), (7) and also for supplying heat to the fluid bed through the reactor walls.

The reactor is charged with 200 kg of catalyst mass of particle size from 200 to 400 μm. The mass is initially fluidized and circulated by nitrogen injections through lines (6) and (7) and heated to a temperature of about 750° C. by electric furnaces. The pressure is adjusted to about 50 bars. Nitrogen is then replaced with about 130 kg/h of steam, preheated at 600° C., and 100–150 $Nm^3/h$ of hydrogen, preheated at 400°–6000° C., respectively supplied through lines (7) and (6). Then, about 100 kg/h of asphalt, preheated at 320° C., are introduced into the reactor, in admixture with hydrogen, at the bottom of the central tube. The average temperatures of the hydrolysis and gasification zones can be measured by thermocouples placed respectively at the middle of the central tube and the middle of the annular fluid bed.

The reaction products discharged through line (10) are cooled to room temperature, expanded and separated into two liquid phases (aqueous and hydrocarbon) and a gas phase. After a few hours necessary to obtain stable running conditions, the material balance of the plant is determined over one hour of run: the gas phase is measured with a volumetric meter and analyzed by chromatography, the liquid hydrocarbons phase is filtered, weighed and fractionated by distillation to a light distillate of 40°–180° C. normal boiling point, a middle distillate of 180°–400° C. normal boiling point and a heavy oil of normal boiling point higher than 400° C., subjected to elementary analyses. The results are expressed as conversion rate of carbon and of the charge to different carbonaceous products.

The operating conditions and the results of the comparative tests are reported in Table I.

EXAMPLE 1 (comparison)

The reactor is charged with 200 kg of petroleum coke, produced by "Fluid Coking", of 200–300 μm granulometry and of 4 $m_2/g$ specific surface, without catalyst addition. After 2 hours of operation, the material balance (Table I) shows that only 70% of the carbon of the charge is found in the products of the reactor effluent. When opening the reactor, coke accumulation is observed on the initial mass, now weighing 278.4 kg (3 hours of run).

EXAMPLE 2

Example 1 is repeated but the reactor is initially charged with 200 kg of a catalyst mass obtained by dry mixing of 170 kg of the same petroleum coke as in example 1 with 30 kg of $K_2CO_3$. The balance, after 2 hours of run, shows that the whole carbon of the charge is found in the reactor output products and that the yields of gaseous and liquid hydrocarbons are substantially improved as compared with the test of example 1. This last point is a proof that the catalyst acts not only on the rate of coke gasification by steam, but also on the selectivity of the asphalt hydropyrolysis, by favouring the formation of hydrocarbons, instead of coke.

EXAMPLE 3 (comparison)

The test of example 1 is repeated but with 200 kg of a catalyst mass containing 6% by weight of $Fe_2O_3$, prepared as follows: 188 kg of coke identical to that of example 1 are introduced into the reactor. The bed of fluidized coke is circulated by means of nitrogen injections and heated to 400° C.; then, 100 liters of an aqueous solution containing 60.6 kg of $Fe(NO_3)_3$, 9 $H_2O$ are progressively injected.

The mass is then heated to 750° C. and used as in example 1. The total conversion rate of the carbon of the charge to volatile products and the yields to hydrocarbons are improved as compared with example 1, but to a smaller extent than in example 2.

EXAMPLE 4

The test of example 1 is repeated with 200 kg of a catalyst mass containing 15% by weight of $K_2CO_3$ and 5.1% by weight of $Fe_2O_3$, prepared as follows: 170 kg of catalyst mass, prepared as in example 3, are introduced into the reactor. Then 30 kg of crystallized $K_2CO_3$ are added, while circulating the fluid bed.

The total conversion rate of the carbon of the charge to volatile products reaches 100% (even a small portion of the coke of the catalyst mass is gasified as a result of the oversizing of the gasification zone). In addition, the yield to hydrocarbons is still improved with respect to the preceding tests.

EXAMPLE 5

The test of example 1 is repeated with 200 kg of catalyst mass containing 10% by weight of $CaCO_3$ and 3% by weight of NiO on an alumina carrier, prepared as follows: 174 kg of alumina, of 200–300 μm granulometry and 25 $m^2/g$ specific surface, are introduced into the reactor. The alumina is fluidized, circulated by nitrogen injections and heated to 400° C.; then 100 liters of an aqueous solution containing 31.6 kg of calcium acetate and 50 liters of an aqueous solution containing 23.4 kg of Ni $(NO_3)$, 6 $H_2O$, are successively introduced.

The total conversion rate of the carbon of the charge to volatile products, as well as the yields to gaseous and liquid hydrocarbons, are clearly improved as compared with example 1.

EXAMPLE 6

The test of example 1 is repeated with 200 kg of catalyst containing 15% by weight of $Na_2CO_3$ and 5% by weight of $Fe_2O_3$ on a kaolin carrier, prepared as follows: 160 kg of kaolin, of particle size from 250 to 350 μm and 9 $m^2/g$ specific surface, are introduced into the reactor. The bed is fluidized, circulated by means of nitrogen, heated to 400° C., and then 200 liters of an aqueous solution containing 30 kg of $Na_2CO_3$ and 100 liters of an aqueous solution containing 50.5 kg of $Fe(NO_3)_3$, 9 $H_2O$ are successively introduced.

The total conversion rate of the carbon of the charge to volatile products as well as the yields to gaseous and liquid hydrocarbons are clearly improved as compared with example 1.

EXAMPLES 7 and 8

The reactor is fed with a charge of 162.4 kg of coke identical to that of example 1. The bed is fluidized, circulated by nitrogen injections and heated to 400° C. 60 liters of aqueous solution containing 30 kg of $K_2CO_3$, then 10 liters of aqueous solution containing 4.7 kg of $Ni(NO_3)_3$, 6 $H_2O$ and then 160 liters of hot aqueous solution containing 8.2 kg of $NH_4VO_3$, are progressively introduced. Thus 200 kg of catalyst are obtained which contain 15% by weight of $K_2CO_3$, 0.6% by weight of NiO and 3.2% by weight of $V_2O_5$.

The operating conditions, particularly the hydrogen flow rate, are so adjusted as to obtain an average temperature, in the hydropyrolisis zone, of 651° C. in example 7 and 748° C. in example 8, the temperature of the gasification zone remaining substantially the same as in the preceding tests.

It is observed that the increase of the hydropyrolysis step temperature results in an increased proportion of gaseous hydrocarbons with respect to liquid hydrocarbons, their sum remaining substantially constant and close to that of example 4.

TABLE I

| EXAMPLE | 1 | 2 | 3 | 4 |
|---|---|---|---|---|
| Charge flow rate (kg/h) | 100.2 | 100.8 | 99.5 | 101 |
| $H_2O$ flow rate (kg/h) | 130 | 125.8 | 129.2 | 132 |
| $H_2$ flow rate ($Nm^3/h$) | 100.5 | 101.1 | 98.6 | 102.3 |
| Hydropyrolysis zone (T °C.) | 552 | 551 | 549 | 553 |
| Gasification zone (T °C.) | 750 | 751 | 748 | 755 |
| P (bars) | 50 | 50 | 50 | 50 |
| Catalyst mass | Coke | Coke + 15% b. w $K_2CO_3$ | Coke + 6% b. w $Fe_2O_3$ | Coke + 15% b. w $K_2CO_3$ 5.1% b. w $Fe_2O_3$ |
| Conversion rate (%) of C of charge in | | | | |
| $CH_4$ | 4.3 | 8.9 | 6.8 | 9.6 |
| $C_2H_6$ | 7.1 | 9.1 | 8 | 9.9 |
| $C_3$-$C_4$ | 1.2 | 1.1 | 1.2 | 1.4 |
| Light distillate | 9.4 | 10.2 | 9.7 | 12.1 |
| Middle distillate | 33.1 } 52.6 | 39.4 } 59.7 | 35.2 } 55.5 | 39.3 } 62.5 |
| Heavy oil | 10.1 | 10.1 | 10.6 | 11.1 |
| CO | 2 | 7.3 | 4.6 | 5.4 |
| $CO_2$ | 2.8 | 14.4 | 9.3 | 12.4 |
| TOTAL | 70 | 100.5 | 85.4 | 101.2 |
| $H_2$ INPUT − $H_2$ OUTPUT (kg/h) | −0.13 | +1.75 | +1.05 | +0.24 |

| EXAMPLE | 5 | 6 | 7 | 8 |
|---|---|---|---|---|
| Charge flow rate (kg/h) | 98.5 | 99.8 | 100.4 | 100.5 |
| $H_2O$ flow rate (kg/h) | 129.6 | 128.5 | 130.5 | 131 |
| $H_2$ flow rate ($Nm^3/h$) | 99.2 | 101 | 125.2 | 150.5 |
| Hydropyrolysis zone (T °C.) | 551 | 555 | 651 | 748 |
| Gasification zone (T °C.) | 748 | 745 | 752 | 752 |
| P (bars) | 55 | 55 | 50 | 50 |
| Catalyst mass | $Al_2O_3$ + 10% b. w $Ca_2CO_3$ 3% b. w NiO | Kaolin + 15% b. w $Na_2CO_3$ 5% b. w $Fe_2O_3$ | Coke + 15% b. w $K_2CO_3$ 0.6% b. w NiO 3.2% b. w $V_2O_5$ | Coke + 15% b. w $K_2CO_3$ 0.6% b. w NiO 3.2% b. w $V_2O_5$ |
| Conversion rate (%) of C of charge in | | | | |
| $CH_4$ | 8.2 | 9.3 | 22.2 | 31.5 |
| $C_2H_6$ | 8.8 | 9.3 | 21.3 | 30.4 |
| $C_3$-$C_4$ | 1.3 | 1.2 | 0.8 | 0.1 |
| Light distillate | 9.9 | 11.8 | 8.3 | 7.1 |
| Middle distillate | 36.9 } 59 | 37 } 60.4 | 21 } 36.9 | 5.9 } 18.3 |
| Heavy oil | 12.2 | 11.6 | 7.6 | 5.3 |
| CO | 6.4 | 5.2 | 6.3 | 6.5 |
| $CO_2$ | 12.3 | 11.8 | 11.9 | 12.4 |
| TOTAL | 96 | 97.2 | 99.4 | 99.2 |
| $H_2$ INPUT − $H_2$ OUTPUT (kg/h) | +1.38 | +0.59 | −2.1 | −5 |

What is claimed as the invention is:

1. An integrated process for converting heavy petroleum residues to hydrogen and to gaseous and distillable hydrocarbons, comprising:

(a) a first step wherein the petroleum residue and hydrogen are simultaneously contacted, for about 0.1–60 seconds with a supported catalyst containing at least one oxide or carbonate of alkali or alkaline-earth metal, obtained in step (b), at a temperature of 530°–800° C., under a pressure of 15–100 bars, to produce hydrocarbons gases and vapors, and coke which deposits on the catalyst, the coked catalyst being separated from said hydrocarbons, (b) a second step wherein the coked catalyst, separated from hydrocarbons in step (a), is contacted with steam, substantially in the absence of molecular oxygen, at a temperature of 600°–800° C., under a pressure of 15–100 bars, for a sufficient time to gasify at least 90% of the deposited coke, to hydrogen, carbon monoxide, carbon dioxide and methane, said catalyst being recycled to step (a).

2. A process according to claim 1, wherein the pressure is substantially the same in both steps (a) and (b).

3. A process according to claim 1, wherein the content of alkali and alkaline-earth metals of the catalyst is from 1 to 50% by weight.

4. A process according to claim 1, wherein the catalyst comprises at least one sodium, potassium or calcium oxide or carbonate and at least one carrier.

5. A process according to claim 4, wherein the carrier is selected from the group of alumina, titanium oxide, limestone, dolomite, clay and oil coke.

6. A process according to claim 1, wherein the catalyst comprises at least one potassium, sodium or calcium oxide or carbonate and at least one compound of iron, vanadium or nickel, the metal proportion of the latter compound being from 0.01 to 0.5 atom per atom of potassium, sodium or calcium.

7. A process according to claim 1, wherein each of steps (a) and (b) is conducted in at least one vertically elongated reaction zone, said zones being arranged in a common enclosure and communicating with each other, step (a) being performed with ascending co-currents of petroleum residue, hydrogen and catalyst, and step (b) with an ascending current of steam and a descending current of catalyst; hydrogen, petroleum residue and steam being introduced at the bottom of their respective reaction zones and the products withdrawn from the top of said respective reaction zones.

8. A process according to claim 1, wherein the catalyst flow rate is 1–15 tons per ton of petroleum residue and the steam amount is 1.5–8 tons per ton of coke introduced with the catalyst in step (b).

9. A process according to claim 1, wherein the hydrogen flow rate is 200–3000 $Nm^3$ per ton of petroleum residue in the first step.

10. A process according to claim 1, wherein the contact time is about 0.5 to 30 seconds.

11. In a process for converting heavy petroleum residues to hydrogen and to gaseous and distillable hydrocarbons, comprising:

(a) a first step wherein the petroleum residue and hydrogen are simultaneously contacted with a supported catalyst containing at least one oxide or carbonate of alkali or alkaline earth metal, obtained in step (b), to produce hydrocarbon gases and vapors, and coke which deposits on the catalyst, the coked catalyst being separated from said hydrocarbons, and (b) a second step wherein the coked catalyst, separated from the hydrocarbons in step (a), is contacted with steam, for a sufficient time to gasify at least 90% of the deposited coke, to hydrogen, carbon monoxide, carbon dioxide and methane, said catalyst being recycled to step (a), the improvement comprising conducting step (a) in at least one vertically elongated reaction zone, and conducting step (b) in at least one vertically elongated reaction zone separate from the step (a) reaction zone, all of said zones being arranged in a common enclosure and each zone of step (a) communicating with at least one zone of step (b), step (a) being performed with ascending co-currents of petroleum residue, hydrogen and catalyst and step (b) with an ascending current of steam and a descending current of catalyst; hydrogen, and petroleum residue being introduced at the bottom of each vertically elongated reaction zone of step (a) and steam being introduced at the bottom of each vertically elongated reaction zone of step (b), and resulting reaction products being withdrawn from the top of each zone, said improvement further comprising contacting the catalyst, petroleum residue and hydrogen in step (a) for about 0.1 to about 60 seconds and conducting step (b) substantially in the absence of molecular oxygen.

12. A process according to claim 11, wherein said vertically elongated reaction zones are arranged concentrically about a vertical axis such that the zones comprise an inner zone and an outer zone, said outer zone completely surrounding said inner zone.

13. A process according to claim 12, wherein step (a) takes place essentially in said inner zone, and step (b) takes place essentially in said outer zone, and wherein a single catalyst bed is present in the common enclosure.

* * * * *